US005417739A

United States Patent [19]

Watkins et al.

[11] Patent Number: 5,417,739

[45] Date of Patent: May 23, 1995

[54] METHOD OF MAKING HIGH NITROGEN CONTENT STEEL

[75] Inventors: Richard R. Watkins, St. John; Robert Blossey, Portage; Gregory Wotell, Merrillville, all of Ind.

[73] Assignee: LTV Steel Company, Inc., Cleveland, Ohio

[21] Appl. No.: 175,730

[22] Filed: Dec. 30, 1993

[51] Int. Cl.[6] ..... C21C 7/10

[52] U.S. Cl. ..... 75/508; 75/512; 420/128

[58] Field of Search ..... 75/508, 512; 420/128

[56] References Cited

U.S. PATENT DOCUMENTS

| | | | |
|---|---|---|---|
| 3,320,053 | 5/1967 | Lehman . | |
| 3,594,155 | 7/1971 | Ramachandran . | |
| 3,700,429 | 10/1972 | Ramachandran | 75/512 |
| 3,754,892 | 8/1973 | Ando et al. . | |
| 3,861,888 | 1/1975 | Heise et al. . | |
| 3,932,172 | 1/1976 | Knuppel et al. . | |
| 3,941,623 | 3/1976 | Takashina et al. . | |
| 3,953,199 | 4/1976 | Michaelis . | |
| 3,955,964 | 5/1976 | MacDonald et al. . | |
| 4,004,920 | 1/1977 | Fruehan . | |
| 4,348,229 | 9/1982 | Suemure et al. . | |
| 4,490,172 | 12/1984 | Moore et al. . | |
| 4,564,390 | 1/1986 | Gupta et al. . | |
| 4,615,730 | 10/1986 | Tommaney . | |
| 4,979,997 | 12/1990 | Kabayashi et al. . | |
| 5,045,129 | 9/1991 | Barisoni . | |
| 5,062,905 | 11/1991 | Tomita et al. . | |
| 5,145,533 | 9/1992 | Yoshitomi et al. . | |

FOREIGN PATENT DOCUMENTS

| | | | |
|---|---|---|---|
| 1012320 | 1/1976 | Japan | 75/512 |
| 1395682 | 11/1986 | U.S.S.R. . | |

OTHER PUBLICATIONS

Yasuda et al., *Kawasaki Steel Report,* No. 12, pp. 45–54 (Jul. 1985).

*Primary Examiner*—Melvyn J. Andrews

*Attorney, Agent, or Firm*—Watts Hoffmann Fisher & Heinke

[57] ABSTRACT

A method of making stabilized ultra-low carbon steel having a high nitrogen content for enameling applications. The preferred method involves two phases. The first phase occurs in the basic oxygen furnace wherein nitrogen gas is combined with oxygen gas and blown into the melt through the oxygen lance. After the oxygen blow the carbon content of the melt is approximately 0.03% and the nitrogen content is at least about 0.016 to 0.020%. In the second phase the melt is introduced to a vacuum circulation decarburizer where the carbon content of the steel is reduced to ultra low levels on the order of 0.005%. The nitrogen content is maintained at a level of at least about 0.01% by introducing nitrogen gas into the vacuum decarburization vessel as the lift gas through inert gas tuyeres.

21 Claims, No Drawings

METHOD OF MAKING HIGH NITROGEN CONTENT STEEL

BACKGROUND OF THE INVENTION

This invention relates to the manufacture of steels that have a high nitrogen content. More particularly, the invention is directed to a method of making ultra-low carbon enameling steels that are stabilized for good formability and that have a high nitrogen content for excellent enameling characteristics.

For many uses, enameling steel must be of a high grade with sufficient formability and drawability to be molded into, for example, bath tubes, sinks and the like. To impart suitable formability characteristics to the steel, the steel is stabilized with reactive alloying elements such as titanium, columbium and boron. In the past, stabilized enameling steels have contained on the order of 0.02% carbon. The level of reactive alloying elements necessary to stabilize this level of carbon resulted in significant quantities of deoxidation products, such as alumina, contained in the immediate subsurface of the steel. In order to make a satisfactory product for many of the applications to which such steels were to be applied, it was necessary to completely remove this surface at significant cost in manpower and yield. The problems associated with surface defects in the stabilized steel can be reduced or eliminated by utilizing stabilized ultra-low carbon (ULC) steel i.e., steel containing only about 0.005% carbon. Steels containing only about 0.005% carbon can be stabilized with smaller amounts of stabilizing elements and thereby provide the desired formability and drawability properties without the associated surface defects. However, while ultra-low carbon chemistry provides the necessary formability and surface characteristics, ULC steel alone will not suffice for enameling purposes. Steel that is to be enameled must generally have the ability to resist the formation of so called "hydrogen defects."

The presence of moisture during the enameling of the steel will inevitably result in a certain amount of hydrogen being dissolved in the solid steel. Unless the steel contains a component or components that will scavenge and hold the hydrogen within the steel, the hydrogen will gradually escape from the steel and cause defects in the overlying enamel that is subsequently coated thereon. The most problematic hydrogen defect occurring in the enamel is known as "fish scale." Since this problem may not appear for days or weeks after the steel is enameled, the defective steel may already be incorporated into the final product and installed in, for example, a new home before the it manifests itself. This results in significant losses in terms of time, manpower, productivity and ultimately cost to the steel manufacturer, the product manufacturer and the consumer. Another enameling defect manifests itself as bubbles or discolorations in the overlying enamel.

In order to obtain satisfactory enameling properties in stabilized ultra-low carbon steel it has been found that a high nitrogen content is extremely useful. While it is normally desirable to maintain a low nitrogen content in ULC steel, a sufficiently high nitrogen content has been found to reduce or eliminate hydrogen defects by forming hydrogen scavenging reaction products such as TiN, ZrN and BN in the steel. These reaction products prevent the hydrogen from escaping and causing defects in the overlying enamel.

One way to get nitrogen into the steel is by adding nitrogen containing alloys, such as nitrided manganese and nitrided calcium after the oxygen blowing cycle in a Basic Oxygen Furnace (BOF). However, since these alloys are quite expensive they increase the cost of the process and the steel. Such alloys also tend to distort the carbon/oxygen ratios in the steel so that there is frequently insufficient oxygen present to process the steel to ultra-low carbon levels by vacuum circulation decarburization. Nitrogen can also be added in the vacuum degassing process by using nitrogen instead of argon for the lift gas from the tuyeres in the so called "up leg" snorkel of an RH degasser. However, the recovery is variable and will not provide an adequate nitrogen content to prevent hydrogen defects. Nitrogen can also be added in the BOF using the inert gas tuyeres. However, the results will again be variable and insufficient to achieve the target chemistry. Although combinations of these practices may, on occasion, result in adequate nitrogen and carbon in the product, the results of the combinations, as with the individual practices, will be variable and insufficient to make the necessary steel chemistry with adequate reproducibility.

In order to adequately address the formability requirements of high end enameling customers, while at the same time provide a steel which contains sufficient hydrogen absorption capability to avoid fish-scale and other enameling defects, it is desirable to use fully stabilized ultra low carbon content steel to achieve suitable formability and, at the same time, have nitrogen values in excess of 0.01% to form the inclusions necessary to hold excess hydrogen. This is a significantly higher nitrogen content than normal ultra-low carbon steel, which is typically only on the order of 0.006% and below. This combination of requirements is unique to enameling steel and necessitated the development of the inventive process. Prior to the inventive method, nitrogen contents could not be maintained at a high enough level to make ultra low carbon enameling steel.

DISCLOSURE OF THE INVENTION

The method of the invention enables the production of optimum enameling steel chemistry, i.e., a stabilized ultra-low carbon steel having a high nitrogen content. The preferred steel chemistry has a carbon content not greater than about 0.005% by weight, and a nitrogen content of not less than about 0.01% by weight. For the first time this optimum steel chemistry can be obtained consistently and economically. It is impossible to make this steel on a routine basis with reproducible results by any other method known to the inventors.

The method of the invention is intended for primary application to basic oxygen processes. In the preferred embodiment the method employs a basic oxygen furnace (BOF). As is known in the art, basic-oxygen processes typically involve the charging of molten iron, steel scrap and other components for the formation of the steel product into a metallurgical vessel adapted to receive a high pressure stream of oxygen, typically from an oxygen lance. A high velocity stream of high purity oxygen from the lance is blown into the molten ferrous starting materials to refine them into steel. The details of basic oxygen processes in general, and of the Basic Oxygen Furnace (BOF) in particular, are well known to those of ordinary skill in the art. Similarly, as is known in the art of manufacturing ultra-low carbon steels, once the carbon content is reduced by the oxygen blowing process, the carbon content of the melt is further reduced to ultra low levels by additional decarburization processes, such as vacuum circulation decarburization (VCD) in a so called vacuum alegasser. In the vacuum decarburization process the melt is introduced into a low pressure environment so that carbon and oxygen reaction products such as carbon monoxide are evolved out of the melt as gaseous reaction products. On occasion, additional oxygen is introduced into the molten metal bath during decarburization to adjust the carbon to oxygen ratio for optimum carbon evolution. As is known in the art, inert gas is also introduced, typically through tuyeres submerged in the bath, to reduce the partial pressure of the CO and to agitate and stir the bath. The preferred method of the invention involves a two phase approach wherein the steel melt is treated both during the oxygen blowing process and again during the subsequent decarburization process. While the method is described herein in the context of the basic-oxygen furnace and vacuum degasser, it is contemplated that it will be applicable to other oxygen blowing processes known to those of ordinary skill in the art.

In the first aspect of the inventive process nitrogen gas is introduced into the molten ferrous charge at some point during the oxygen blowing cycle. Ideally this is done by mixing nitrogen gas with the oxygen and blowing the combined gases into the melt through the oxygen lance together. This enables the nitrogen to be injected directly into the oxygen reaction zone, which is the region in the melt where the oxygen reacts with and ignites the molten charge. The maximum amount of nitrogen will go into solution in this region because it is the hottest region in the melt. While not wanting to be bound by theory, it is believed the solubility of the nitrogen is highest in the oxygen reaction zone because the temperature in this region is sufficient to form monaromic nitrogen from the less soluble diatomic nitrogen. Normally, nitrogen gas occurs as the diatomic molecule $N_2$, which has little or no solubility in liquid metal. However, the temperatures existing in the oxygen reaction zone during blowing are believed to be sufficient to form monatomic nitrogen which is substantially more soluble in the liquid metal. Thus, while introducing the gases together through the oxygen lance is the optimum means of ensuring maximum nitrogen uptake, nitrogen injection could be accomplished by other means, such as with a second lance having sufficient pressure to get the nitrogen into the reaction zone. Theoretically, this could also be done through tuyeres in the furnace. However, since the tuyeres blow with significantly less pressure than the lance, the tuyeres would have to be modified to blow with sufficient pressure to get the nitrogen into the melt. Of course, nitrogen introduction through the lance or lances can be augmented with nitrogen introduction through the tuyeres and/or the addition of nitrogen containing alloys.

Since the introduction of nitrogen gas will have a limited cooling effect, the nitrogen gas is preferably introduced into the lance flow after the oxygen blow has had sufficient time to begin reducing the carbon content of the melt. It may also be desirable to increase the target blowing temperature above what would normally be employed for a given charge in order to compensate for any cooling effect. As is known in the art, the oxygen blowing process is typically complete within about 20 to 35 minutes. In the first phase of the method the carbon content of the melt is reduced to about 0.02 to 0.03% by weight based on the weight of the steel, with an associated dissolved oxygen content above about 500 ppm. The nitrogen content after the first phase should be at least about 0.01 to 0.015% by weight based on the weight of the steel. Preferably, the nitrogen content is higher than 0.015% after the first phase. If the nitrogen content is too low, the melt should be re-blown with the combined oxygen and nitrogen gas. The oxygen content of the melt after the first phase should be preferably controlled to exceed the carbon content by about 150 ppm, which provides a good carbon/oxygen ratio for successful vacuum decarburization to ultra low carbon levels. To obtain the ultra-low carbon levels the melt is then moved to the vacuum degasser.

In the second phase the heat is further processed to ultra low carbon levels by vacuum decarburization. The key factor at this stage, assuming that sufficient oxygen is present to remove the carbon, is to retard the loss of nitrogen. While not wanting to be bound by theory, nitrogen loss from the degasser is believed to be driven by at least two mechanisms. First, the vacuum reduces the partial pressure of the nitrogen above the bath. This reduction changes the equilibrium between the nitrogen dissolved in the steel and its surroundings and causes some nitrogen to be lost by simple effervescence. The second factor in nitrogen loss is the "scrubbing" effect of the CO bubbles that are created when the heat is decarburized. This second effect is addressed by the invention.

By using nitrogen gas as the lift gas through the degasser tuyeres, some of the CO bubbles are "salted" with nitrogen, reducing the propensity of these bubbles to remove or "scrub" nitrogen from the bath. Introducing nitrogen into the degasser through tuyeres is the preferred method. However, there will be other ways to introduce the nitrogen into the melt during the decarburization process as would be known to those of ordinary skill in the art. Secondly, by presenting the degasser with starting carbon levels that are already relatively low from the oxygen blowing process, the quantity of CO evolved during decarburization is limited. Of course, if the carbon content of the melt is still too high when introduced to the degasser, it may sometimes be necessary to introduce oxygen into the bath during the vacuum decarburization in order to provide adequate stoichiometry for CO evolution, or to use argon or other inert gas from the tuyeres to further reduce the partial pressure of the CO. In the later case, argon can be mixed with nitrogen through the tuyeres, or the two gases can be blown from the tuyeres in an alternating fashion.

In the second phase of the inventive method, the steel is processed to ultra low carbon levels of less than about 0.005%, while maintaining a high nitrogen content of no less than about 0.01%. The resulting steel has excellent formability and resistance to hydrogen defects making it especially suitable for high end enameling applications.

In accordance with the foregoing, the invention provides a method of making high nitrogen content steel from a charge comprising a quantity of molten ferrous metal. The preferred method comprises blowing oxygen gas into the molten ferrous metal charge to reduce the carbon content of the ferrous metal and blowing a first proportion of nitrogen gas into the molten metal. At least a portion of the molten charge is then introduced into a low pressure environment to further reduce the carbon content of the metal and, while therein, a second proportion of nitrogen gas is introduced into the molten metal. Such a method results in the optimum chemistry for ultra low carbon stabilized enameling steel. In a preferred embodiment, the first proportion of nitrogen gas is introduced into the oxygen reaction zone of the molten metal. This is preferably accomplished by blowing the oxygen gas and the first proportion of nitrogen gas as a combined gas stream from a high pressure lance. Preferably, the nitrogen gas is blown in an amount of from about 5% to about 20% by weight based on the weight of the combined oxygen and nitrogen gas blown into the molten metal. In a preferred embodiment, the low pressure environment is a vacuum degasser and the second proportion of nitrogen gas is introduced through tuyeres in the vacuum degasser.

In one embodiment the carbon content of the ferrous metal is reduced to no more than about 0.03% by weight based on the weight of the molten ferrous metal prior to introducing the molten metal to the low pressure environment. In the preferred embodiment, sufficient nitrogen gas is introduced to the molten ferrous metal to bring the nitrogen content thereof to no less than about 0.01% by weight based on the weight of the molten metal prior to introduction to the low pressure environment. Preferably, the molten metal is maintained in the low pressure environment until the carbon content of the metal is reduced to about 0.005% by weight based on the weight of the molten metal. In still another preferred embodiment, the charge is prepared to include one or more elements selected from the group consisting of titanium, boron and zirconium.

Many additional features, advantages and a fuller understanding of the invention will be had from the following detailed description of preferred embodiments.

DETAILED DESCRIPTION OF THE PREFERRED EMBODIMENTS

The first phase of the preferred method takes place in the basic oxygen furnace after being charged with the necessary starting materials, typically on the order of about 75% molten iron and 25% scrap. The ratio is determined by a heat and mass balance for a given charge. In order to provide the nitrogen gas necessary to achieve the required chemistry, a high pressure nitrogen gas line was tapped into the main oxygen line of each oxygen lance at a BOF converter. The nitrogen line is tapped into the oxygen line between the lance and the oxygen flow regulating equipment so that the oxygen source and nitrogen source can be regulated independently. To compensate for the thermal effects of the nitrogen gas the target temperature of the blow may be increased above the normal target temperature for a given charge. For example, the target temperature can be increased by 40° F. so that instead of entering a target temperature of 2950° F. for the blow, one would input a target temperature of 2990° F. Otherwise, the oxygen blowing sequence is commenced in the normal fashion known to those of ordinary skill in the art for BOF processing. The aim in this phase is to reduce the carbon content to between about 0.02 and 0.03%, preferably about 0.028 %, in order to allow for the greatest possible nitrogen uptake during a period of the blow where minimal CO gas is being generated. The target temperature, oxygen volume and duration of the blow will vary from charge to charge. The appropriate calculations for the blow parameters are well known to those of ordinary skill in the art.

As the oxygen blowing sequence in the BOF approaches completion, and the carbon content of the steel is being reduced, nitrogen is added to the oxygen line. Ideally, the nitrogen flow is commenced at the point in the blow where about 65% of the predicted oxygen volume has been blown. At this point the oxygen flow rate is approximately 19,000 standard cubic feet per minute (SCFM). The nitrogen is introduced at a flow rate of approximately 3000 SCFM. The resultant mixture of oxygen and nitrogen is blown through the oxygen lance into the bath for the balance of the required oxygen blow and causes the nitrogen content of the bath to increase, while allowing the carbon to continue to decrease. The introduction of nitrogen to the oxygen stream does not effect the total amount of oxygen required to reach the endpoint calculated by the heat and mass balance.

The nitrogen gas content in the stream from the oxygen lance is about 5–20% by weight based on the weight of oxygen and nitrogen in the stream. Preferably, the nitrogen content is about 10%. If the nitrogen content is too low, insufficient nitrogen will be dissolved in the steel to prevent hydrogen defects in the enameled product. If the nitrogen content is too high, there will not be enough oxygen in the stream to ignite and react with the charge and sufficiently reduce the carbon content. At turndown, the dissolved nitrogen content is measured before proceeding to the second phase of the inventive method. Based on the measured nitrogen content it may be necessary to take corrective action to ensure that the final nitrogen content is at least between 0.01 to 0.015% prior to proceeding to the degasser. If the nitrogen content is below 0.01% the melt is re-blown with the combined nitrogen and oxygen stream. If the nitrogen content is between about 0.010 and 0.015%, it is desirable to add nitrided manganese or similar nitrogen containing alloy during tap. In the case of the typical charge about 1500 pounds of nitrided manganese should be added. If the nitrogen content is over about 0.015%, the melt can proceed to the degasser without modification. However, it may in some cases be desirable to combine several nitrogen adding techniques to further increase the nitrogen content even prior to the termination of the initial blowing sequence. For example, nitrogen containing alloys such as nitrided manganese can be added to the melt and/or nitrogen gas can be introduced to the melt through tuyeres in the BOF to augment the nitrogen supply.

In addition to bringing the nitrogen content of the heat to about 0.01% or greater, the use of this technique typically allows the resultant chemistry of the heat, after tap, to be such that the oxygen content of the bath exceeds the carbon content by more than 150 ppm. Additionally, the carbon content of the heat, after tap, can be restricted to below 300 ppm. This provides good chemistry for the second decarburization phase. The combination of low carbon, high nitrogen and adequate oxygen to carbon ratio is important to the production of ultra-low carbon enameling grade steel.

At the completion of the first phase of the inventive process, the steel comes out of the BOF at about 0.03% carbon. In the second phase the carbon content is taken down to the 0.0025 to 0.005% ultra low carbon range in the vacuum degasser. By implementation of the second phase of the inventive method, the average nitrogen content can be maintained at values above about 0.012%. In the vacuum degasser, processing to ultra low carbon levels proceeds as normal for vacuum circulation decarburization processing with the exception that the lift gas injected into the vacuum circulation process (VCP) vessel through the inert gas tuyeres is varied according to the nitrogen content of the incoming melt. If the nitrogen content of the incoming melt is less than about 0.016%, the lift gas through the tuyeres is comprised entirely of nitrogen gas. If the nitrogen content of the incoming melt is between about 0.016 and 0.020%, the lift gas may comprise a mixture of nitrogen and argon or other inert gas. If the incoming nitrogen content is above about 0.020%, it may not be necessary to introduce any nitrogen in the VCP and the lift gas can be entirely comprised of argon or other inert gas. As the decarburization process proceeds, the nitrogen content of the heat is reduced into the desired product range of 0.010–0.015%, as will be seen from the following non-limiting example.

EXAMPLE

A basic oxygen furnace was charged with 558,000 lbs. molten iron, 68,000 lbs. scrap, 14,000 lbs. burnt lime and 8,000 lbs. dolomitic lime. The aim turndown temperature was 2950° F. at 0.030% carbon. The calculated oxygen volume was 473,000 scf.

The blowing sequence began at 14:44 at an oxygen flow rate of 23,000 scfm and oxygen pressure of 190 psig. After 300,000 scf of oxygen had blown, nitrogen enrichment of the oxygen was commenced. Approximately 2500 scfm of nitrogen gas at 400 psig. was added to the oxygen line, and the total combined nitrogen and oxygen flow was held at 25,000 scfm at a line pressure of 198 psig. This gas mixture was blown until the total of 450,000 scf of oxygen was blown, at which time the nitrogen was turned off. The oxygen blow was terminated at 474,000 scf oxygen at 15:06. The actual blowing temperature reached 2963° F. The chemistry of the melt at tap was 0.024% carbon, 0.016% nitrogen and 537 ppm oxygen. No additions were made at tap.

The melt was moved to the Ladle Metallurgy Facility heating station where 6000 KWH of electrical energy were added to the heat while it was held for vacuum processing. During the hold time 40 lbs. of antimony was added to provide a product containing 0.005 to 0.010% antimony. A small aluminum addition of 272 lbs. was also made to balance the 0.021% carbon and 533 ppm oxygen (measured at the heating station). The melt was maintained at the heating station for approximately one hour.

After leaving the heating station the heat arrived at the Vacuum Circulation Process (VCP) degassing unit. The oxygen value upon arrival at the VCP was measured at 462 ppm. Degassing commenced at 17:56 and the decarburization cycle proceeded until 18:07. The vessel pressure obtained was 3.4 torr. Based on the incoming nitrogen value, an all argon lift gas was used. Alloy additions at the VCP were 600 lbs. aluminum, 600 lbs. ferrotitanium, 500 lbs. ferrocolumbium and 300 lbs. low carbon manganese. After degassing the heat was at 2895° F. The chemistry of the heat was 0.0018% carbon, 0.011% nitrogen, 0.058% columbium, 0.074% titanium, 0.060% aluminum, about 0.007% antimony and 0.12% manganese.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A method of making high nitrogen content steel from a charge comprising a quantity of molten ferrous metal, said method comprising:

a) blowing oxygen gas into said molten ferrous metal to reduce the carbon content of said ferrous metal;

b) blowing a first proportion of nitrogen gas into said molten metal;

c) introducing at least a portion of said molten metal into a low pressure environment to further reduce the carbon content of said metal and while therein;

d) introducing a second proportion of nitrogen gas into the molten metal.

2. The method according to claim 1 wherein the blowing of said oxygen into said molten metal produces a high temperature oxygen reaction zone, and said first proportion of nitrogen gas is introduced into said oxygen reaction zone.

3. The method according to claim 1 comprising blowing said oxygen gas and said first proportion of nitrogen gas as a combined gas stream from a high pressure lance adapted to direct said gases into said molten metal.

4. The method according to claim 1 or 3 comprising blowing said first proportion of nitrogen gas in an amount of from about 5 to about 20% by weight based on the weight of oxygen gas and nitrogen gas blown into said molten metal.

5. The method according to claim 1 wherein said low pressure environment is a vacuum degasser.

6. The method according to claim 5 comprising introducing said second proportion of nitrogen gas through tuyeres in said vacuum degasser.

7. The method according to claim 1 comprising reducing the carbon content of said ferrous metal to no more than about 0.03% by weight based on the weight of said molten ferrous metal prior to introducing said molten metal to said low pressure environment.

8. The method according to claim 1 comprising introducing sufficient nitrogen gas to said molten ferrous metal to bring the nitrogen content thereof to no less than about 0.01% by weight based on the weight of said molten ferrous metal prior to introduction to said low pressure environment.

9. The method according to claim 1 wherein said molten metal is maintained in said low pressure environment until the carbon content of said metal is reduced to about 0.005% by weight based on the weight of said molten ferrous metal.

10. The method according to claim 1 comprising preparing said charge to include one or more elements selected from the group consisting of titanium, boron and zirconium.

11. A method of making high nitrogen content steel from a charge comprising a quantity of molten ferrous metal, said method comprising:

a) blowing oxygen gas into said molten ferrous metal to reduce the carbon content of said ferrous metal;

b) blowing a proportion of nitrogen gas into said molten metal; and, c) introducing at least a portion of said molten metal into a low pressure environment to further reduce the carbon content of said metal.

12. The method according to claim 11 wherein the blowing of said oxygen into said molten metal produces a high temperature oxygen reaction zone, and said proportion of nitrogen gas is introduced into said oxygen reaction zone.

13. The method according to claim 11 comprising blowing said oxygen gas and said proportion of nitrogen gas as a combined gas stream from a high pressure lance adapted to direct said gases into said molten metal.

14. The method according to claim 11 or 13 comprising blowing said proportion of nitrogen gas in an amount of from about 5 to about 20% by weight based on the weight of oxygen gas and nitrogen gas blown into said molten metal.

15. The method according to claim 11 wherein said low pressure environment is a vacuum degasser.

16. The method according to claim 11 comprising reducing the carbon content of said ferrous metal to no more than about 0.03% by weight based on the weight of said molten ferrous metal prior to introducing said molten metal to said low pressure environment.

17. The method according to claim 11 comprising introducing sufficient nitrogen gas to said molten ferrous metal to bring the nitrogen content thereof to no less than about 0.02% by weight based on the weight of said molten ferrous metal prior to introduction to said low pressure environment.

18. The method according to claim 1 wherein said molten metal is maintained in said low pressure environment until the carbon content of said metal is reduced to about 0.005% by weight based on the weight of said molten ferrous metal.

19. A method of making high nitrogen content steel from a charge comprising a quantity of molten ferrous metal, said method comprising:

a) blowing oxygen gas into said molten ferrous metal to reduce the carbon content of said ferrous metal;

b) blowing a first proportion of nitrogen gas into said molten metal whereby the nitrogen content of said molten ferrous metal is increased to an amount of at least about 0.020% by weight based on the weight of the molten ferrous metal; and, c) introducing at least a portion of said molten metal into a low pressure environment to further reduce the carbon content of said metal.

20. The method according to claim 19 wherein said molten metal is maintained in said low pressure environment until the carbon content of said metal is reduced to about 0.005% by weight based on the weight of said molten ferrous metal.

21. A method of making an ultra-low carbon, high nitrogen enameling steel, said method comprising:

a) blowing oxygen into a bath of molten ferrous metal to reduce the carbon content of said metal;

b) introducing nitrogen gas with the oxygen into said molten metal;

c) subjecting said bath to a low pressure environment to further reduce the carbon content of said metal; and, d) introducing additional nitrogen gas into said molten metal while said metal is subjected to said low pressure environment to produce an ultra-low carbon steel having a high nitrogen content suitable for coating with enamel.

* * * * *